US005810699A

United States Patent [19]

Nadeau

[11] Patent Number: 5,810,699

[45] Date of Patent: Sep. 22, 1998

[54] EXERCISE VEST

[76] Inventor: Todd Nadeau, 1510 Washburn Rd., Davison, Mich. 48423

[21] Appl. No.: 891,043

[22] Filed: Jul. 10, 1997

Related U.S. Application Data

[63] Continuation-in-part of Ser. No. 612,793, Mar. 11, 1996, abandoned.

[51] Int. Cl.[6] ..... A63B 21/06

[52] U.S. Cl. ..... 482/105; 2/94; 2/102

[58] Field of Search ..... 482/74, 105; 2/94, 2/102

[56] References Cited

U.S. PATENT DOCUMENTS

| | | | |
|---|---|---|---|
| 2,948,898 | 8/1960 | Allen | 2/94 |
| 4,106,121 | 8/1978 | Belson | 2/102 |
| 4,344,620 | 8/1982 | Debski . | |
| 4,382,302 | 5/1983 | Watson | 2/102 |
| 4,602,387 | 7/1986 | Zakrzewski | 2/102 |
| 4,761,324 | 8/1988 | Rautenberg et al. | 428/198 |
| 4,989,267 | 2/1991 | Watson | 2/102 |
| 5,002,270 | 3/1991 | Shine | 482/105 |
| 5,024,360 | 6/1991 | Rodriguez . | |
| 5,548,843 | 8/1996 | Chase et al. | 2/102 |
| 5,611,084 | 3/1997 | Garry et al. | 2/102 X |

*Primary Examiner*—Richard J. Apley
*Assistant Examiner*—John Mulcahy
*Attorney, Agent, or Firm*—Charles W. Chandler

[57] ABSTRACT

An exercise vest includes lower and intermediate rows of pockets extending along the outside of its back and side sections. A weight is provided for each pocket. A padded lumbar support belt extends through aligned belt loops on the inside of the vest to cover the area between the lower row of pockets and the user's waist.

6 Claims, 2 Drawing Sheets

1/2

EXERCISE VEST

CROSS-REFERENCE TO RELATED APPLICATIONS

This application is a continuation-in-part of application Ser. No. 08/612,793, filed Mar. 11, 1996, for Exercise Vest now abandoned.

BACKGROUND OF THE INVENTION

This invention is related to an exercise vest worn about a user's midsection while engaged in athletic activity. A wide, padded belt strapped to the inside of the vest assists in supporting the vest, including removable weights, on the user's midsection.

Exercise vests are commonly used by athletes for training for competition. The vest commonly used has a series of pockets for carrying weights which are generally symmetrically about the user's body, above his waist. Other types of vests support loads other than exercise weights.

In the construction and fit of prior art weight-carrying vests, the weight is primarily carried across the user's shoulders, thus severely limiting the user's range of motion at the shoulder and tending to create chafing around the arm pit area. These flaws have reduced the popularity and utility of previous vests since coaches are reluctant to endorse the use of any training device that alters or changes the user's range and form of motion in the shoulder and arm area. In addition, the poor body fit produces chafing, pain and discomfort from the weights bearing against the user's skin.

Such vests also frequently include a belt that is wrapped around the outside of the vest.

Examples of such vests may be found in U.S. Pat. Nos. 4,106,121 which was issued Aug. 15, 1978 to Gary W. Belson for "Tactical Load Bearing Vest"; 4,344,620 which was issued Aug. 17, 1982 to Andre J. Debski for "Exercise Vest"; 4,382,302 which was issued May 10, 1983 to Douglas E. Watson for "Weighted Training Vest Having Constant Weight Distribution"; 4,602,387 which was issued Jul. 29, 1986 to Jacek M. Zakrewski for "Weight Vest"; 4,989,267 which was issued Feb. 5, 1991 to Douglas E. Watson for "Weighted Training Vest for Athletic Activities" and 5,024,360 which was issued Jun. 18, 1991 to Norton Rodriguez for "Vest or Like Article of Clothing for Carrying Rechargeable Batteries". The belts in the Belson, Watson '302, Watson '267 and the Rodriguez patents are mounted around the outside of the vest.

U.S. Pat. No. 2,948,898 which was issued to Robert E. Allen on Aug. 16, 1960 for "Shooting Garment" discloses a narrow belt worn inside a hunting jacket.

SUMMARY OF THE INVENTION

The broad purpose of the present invention is to provide an improved weight-bearing vest useful for athletic and other purposes in which the ergonomic distribution of the weight is located around the user's center of gravity, and the sides of the waist. An inner belt is strapped to the waist, to assure the weight on the vest is supported by the midsection of the body and not along the shoulders to provide lower back support while training. The belt is wide and padded and disposed between the weights and the user to eliminate the problem of chafing. The vest is constructed out of a Darlexx material that stretches to conform to the body yet is strong enough to hold the weights on the vest.

The unique inner belt shifts the weight-bearing from the shoulders to the midsection and, along with the ergonomic distribution of the weight, reduces the stress of the weight placed on the lower back. These features distinguish this invention from other weight-bearing vests. These features are extremely important to users who are jumping and/or running to increase leg strength.

Athletes report the vest distinguishes itself from other vests because the weight does not shift, move or bounce against the body. The athlete can perform any athletic movements without any distraction or discomfort from the vest. The inner securing system secures the weights to the body and cushions the impact of the weight against the body. This is critical since athletes move in many different directions.

The outer Darlexx fabric was utilized for its' special properties that simulate the purpose of skin. The fabric stretches to move and flex with the user's body, it also breathes to prevent overheating. The soft padded inner lining cushions the weight against the user's body. Since a body glove fit is critical to how the vest performs, a range of sizes are provided to suit a variety of user's having different physical sizes, heights and weights.

The weights are one pound each and thin to simulate an additional layer of is weight to the body. The pockets are distributed around the waist where the user naturally carries additional body weight.

The inner padded belt is constructed of an outer nylon and an inner foam material. The belt is shaped to cover the area between the weights and the midsection of the body while not being so wide as to be uncomfortable. The belt is wider around the back and sides and narrows toward the front so when the user bends forward, the belt does not restrict movement or interfering with breathing The loops are wider than the belt to provide flexibility in movement with the body and weights.

The belt loops are positioned at three points, the two sides and back, so that in conjunction with the size, they provide the user with a limited range of flexibility of movement not possible by padding secured directly to the vest between the lower weights and the user's back. Another feature of the belt is that it supports the lumbar area of the user's back.

The preferred embodiment of the invention is constructed of a three ply laminate thermoplastic, designed for its insulative, waterproof/repellent characteristics. This waterproof, windproof, and breathable bidirectional stretch material has great application to sporting and other activities. The Darlexx is disclosed in U.S. Pat. No. 4,761,324. The pockets are constructed of a nylon material, that provides the strength necessary to hold the weights. The vest is closed with an extra durable zipper Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
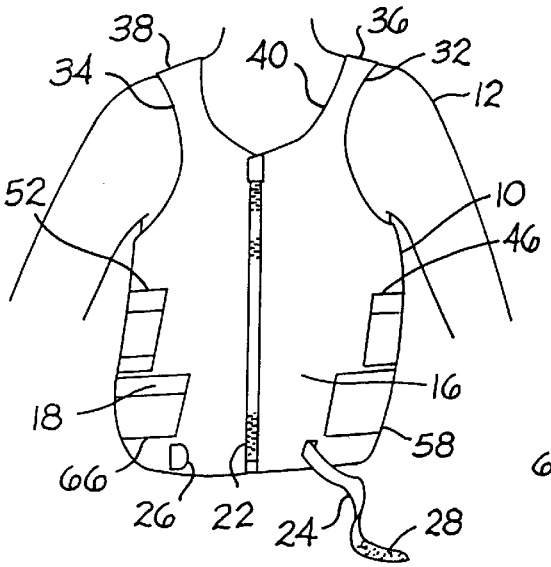
FIG. 1 illustrates a front view of the preferred vest mounted on the upper body of a user.
Figure 2:
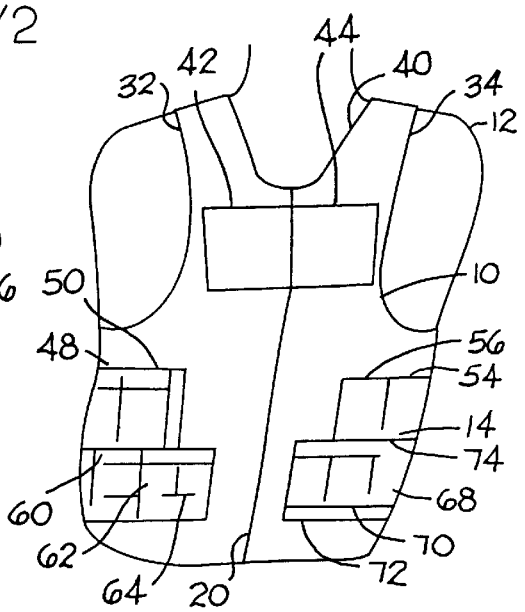
FIG. 2 is a back view of the preferred vest.
Figure 3:
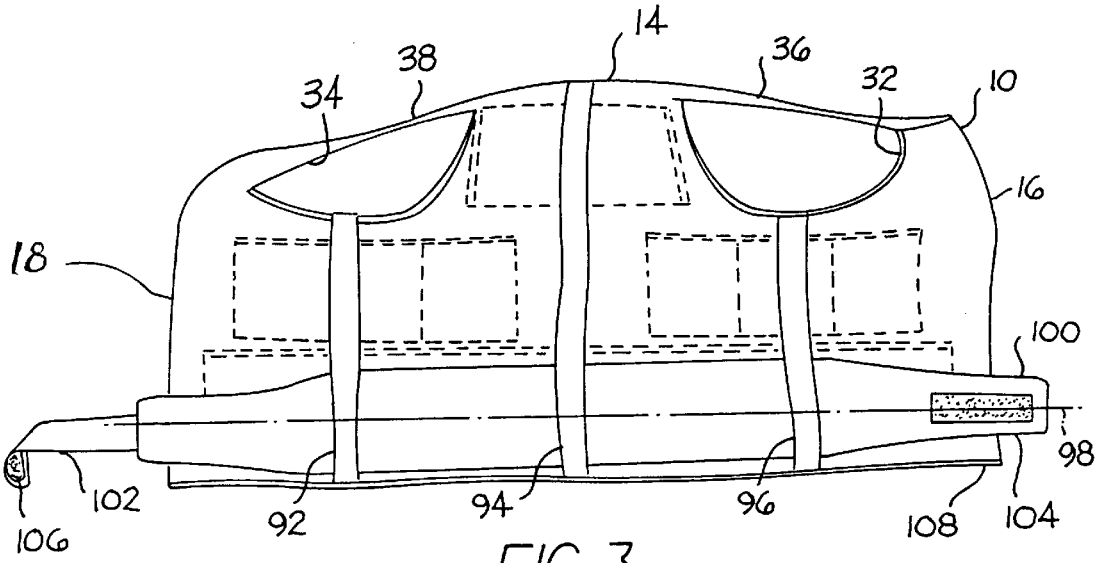
FIG. 3 is an inside view of the open vest showing the manner in which the belt is looped to the vest.
Figure 4:
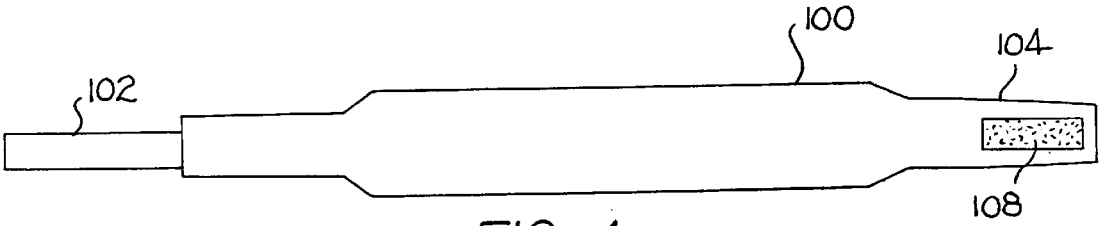
FIG. 4 is a view of the belt.

Referring to the drawings, FIGS. 1 and 2 illustrate a preferred weight-bearing jacket or vest 10 mounted on upper body 12 of a user. As can be seen in FIGS. 1, 2 and 3, the vest is formed with a three ply laminate thermoplastic body 14, preferably of a Darlexx material available from Darlington. This material is waterproof, wind proof, breathable and bidirectional. The body is formed with a left half 16 and a right half 18, vertically stitched up the back at 20. A zipper fastener 22 releasably joins the front edges of the two body halves so that the vest can be opened for admitting the user. A front strap 24, located adjacent the lower front edge of body half 16, is threaded through a loop 26 on the right body half, and then fastened to itself by Velcro fastener means 28 to create a secure fit around the user's waist.

The body of the vest has a pair of arm-receiving openings 32 and 34 defined by a pair of cushioned straps 36 and 38. The two straps are spaced to provide neck opening 40.

The vest is stitched with 16 weight-bearing pockets. Referring to FIG. 2, two horizontally spaced pockets 42 and 44 are located on the back of the vest between arm openings 32 and 34.

A horizontal upper row of six pockets is located beneath arm openings 32 and 34. Three pockets 46, 48 and 50 are located beneath left arm opening 32. The opposite half of the upper row is defined by pockets 52, 54 and 56 located beneath right arm opening 34.

A bottom horizontal row comprises eight pockets. Four pockets 58, 60, 62 and 64 are located beneath left arm opening 32 and beneath pockets 46, 48 and 50. The opposite half of the bottom row comprises pockets 66, 68, 70 and 72. A horizontal stitch 74 defines the top of the bottom row of pockets. The top of the bottom row of pockets is about ¼" below the stitching of the bottom of the upper row of pockets.

Figure 7:
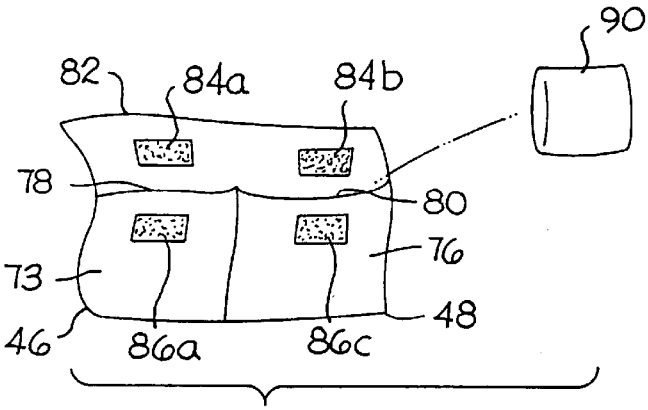
FIG. 7 is a view of a typical pair of weight-bearing pockets.

Referring to FIG. 7, the pockets all have a similar configuration, that is, about 4½" high and 3½"–4" wide. A typical pair of pockets 46 and 48 is formed of an elongated panel 76 stitched to the vest body into a rectangular configuration, with top openings 78 and 80.

An elongated top flap 82 is stitched to the vest body above the four pockets in the row. Thus, each group of pockets has a single flap that may be folded down to close the top openings of the pockets. Each flap has a patch of a hook and loop fastener means 84*a* that mates with a complementary hook and loop fastener means 86*a* to close opening 78. Similarly, a patch of a hook and loop fastener means 84*b* mates with a complementary hook and loop fastener means 86*c* to close top opening 80.

All pockets are formed of a nylon material.

A group of soft, thin, similarly shaped weights, each formed with a plastic coating 90, is inserted in the pockets. Each weight is rectangular, 3½"×3¼". Typically, a weight is carried in each pocket.

The lower horizontal row of pockets is worn generally around the user's waist, above his hips, with the stitch lines defining the bottom of the upper row and the top of the bottom row being separated about ¼".

Referring to FIG. 3, the inside of the vest has three vertical fabric belt loops 92, 94 and 96. The loops are formed of a stretch Darlexx material. The three loops are aligned and generally formed along an axis 98 that is about one-third the distance from the bottom stitching to the top horizontal stitching of the lower row of the pockets. Loop 94 is in the midsection of the vest while the two outer loops 92 and 96 are directly beneath the two arm openings.

A flexible belt 100, formed of a nylon material with an inner foam, is connected around the user's waist to support the vest. Patch cloth nylon is available from Belson Hercules Group, Inc. Belt 100 is about 32" long and has an end strap 102, about 2" wide and 8½" long at one end and a narrowed end 104 at the other end. The rear midsection of the belt has a width about 4" high. The wide rear portion of the back fits over the lumbar vertebrae of the user.

Figure 5:
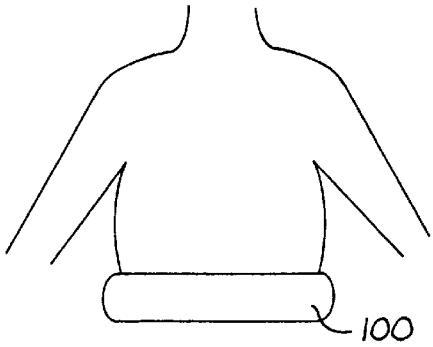
FIG. 5 illustrates the manner in which the belt is wrapped around the back of the user.
Figure 6:
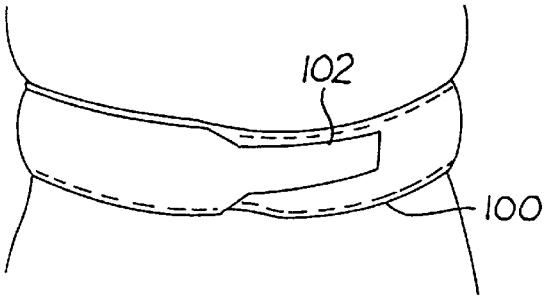
FIG. 6 illustrates how the belt ends are coupled to connect the belt to the user.

Strap 102 carries a patch 106 of a hook fastener means stitched on the front side of narrowed end 104. Thus the two ends of the belt 100 can be connected together around the front of the user's body as illustrated in FIG. 6. FIG. 5 illustrates the way in which the wider midsection of the belt fits over the user's waist and lower lumbar vertebra.

The belt forms a wide cushion between the weights in the pockets and the user's waist.

In use, the user wears the vest around his upper body with his arms inserted in arm-receiving openings 32 and 34. With the wide inserted belt in loops 92, 94 and 96 inside the vest, he connects the ends of the belt snugly around his waist. He then zips together the front edges of the body of the vest to form a snug fit around his body, from his neck down to his waist. He can place weights in the pockets either before or after closing the vest front opening.

The bulk of the weight carried by the vest is located along the two rows of pockets and stitch line 74. The belt wraps the weights in this location firmly around the user's waist so that they will not tend to slip. The balance of the weights and the vest are wrapped around the user's upper body so that very little weight is carried on shoulder straps 36 and 38. By distributing the weight of the vest away from his shoulders and around his upper body, a substantial weight can be carried and used in exercises without concentrating an undue strain on his shoulders.

Having described my invention, I claim:

1. An exercise vest comprising:

a sleeveless jacket adapted to be worn on the user's upper body; said jacket comprising a back section, two side sections extending forwardly from said back section, and two front sections extending from said side sections; said front sections having confronting edges, and fastener means (22) releasably interconnecting said front sections;

a lower row of pockets extending along the back and side sections of said jacket proximate to the jacket lower edge;

for each pocket a weight adapted to be releasably positioned in said pocket;

said jacket having an inner surface and an outer surface; said pockets being located on the jacket outer surface;

said jacket further including a plurality of aligned belt loops on the jacket inner surface proximate to the lower row of pockets; and a relatively wide padded belt extendible through said loops for disposition around a user's waist between the lower row of pockets and the user's waist, to protect the user's waist from a shifting of the weights in said lower row of pockets when the user is exercising.

2. The exercise vest of claim 1, including an intermediate row of pockets located immediately proximate to said lower row of pockets and extending along the back and side sections of the jacket.

3. The exercise vest of claim 2, wherein all of said pockets are the same size, and all of said weights have the same mass and configuration.

4. The exercise vest of claim 2, wherein there are eight pockets in the lower row of pockets, and six pockets in the intermediate row of pockets.

5. The exercise vest of claim 1, wherein said belt has a relatively wide central back section adapted to lie against the user's back, and two relatively narrow end sections connectable together at the user's abdomen.

6. The exercise vest of claim 2, wherein the pockets in each row are symmetrical relative to an imaginary vertical centerline of the jacket back sections.

* * * * *